US012528562B2

(12) United States Patent
Krutzen

(10) Patent No.: US 12,528,562 B2
(45) Date of Patent: Jan. 20, 2026

(54) TELESCOPIC GANGWAY, A MOTION COMPENSATED GANGWAY AND A VESSEL

(71) Applicant: Ampelmann Holding B.V., Delft (NL)

(72) Inventor: Martijn Paulus Maria Krutzen, Delft (NL)

(73) Assignee: Ampelmann Holding B.V., Delft (NL)

( * ) Notice: Subject to any disclaimer, the term of this patent is extended or adjusted under 35 U.S.C. 154(b) by 552 days.

(21) Appl. No.: 18/018,920

(22) PCT Filed: Aug. 2, 2021

(86) PCT No.: PCT/NL2021/050486
§ 371 (c)(1),
(2) Date: Jan. 31, 2023

(87) PCT Pub. No.: WO2022/031165
PCT Pub. Date: Feb. 10, 2022

(65) Prior Publication Data

US 2023/0303220 A1 Sep. 28, 2023

(30) Foreign Application Priority Data

Aug. 3, 2020 (NL) ..... 2026198

(51) Int. Cl.
*B63B 27/14* (2006.01)

(52) U.S. Cl.
CPC ..... *B63B 27/14* (2013.01); *B63B 2027/141* (2013.01)

(58) Field of Classification Search
CPC ..... B63B 27/14; B63B 27/16; B63B 27/30; B63B 2027/141
See application file for complete search history.

(56) References Cited

U.S. PATENT DOCUMENTS 9,278,736 B2 * 3/2016 Van Der Tempel .... B63B 27/30
2024/0400161 A1 * 12/2024 Park ..... A47B 57/06

FOREIGN PATENT DOCUMENTS

CN 111194290 A * 5/2020 ..... B63B 27/30
CN 118323348 B * 8/2024 ..... B63B 27/14
NL 2015891 B1 6/2017

OTHER PUBLICATIONS

International Search Report and Written Opinion—PCT/NL2021/050486—mailing date Oct. 2, 2022.

* cited by examiner

*Primary Examiner* — Gary S Hartmann
(74) *Attorney, Agent, or Firm* — Banner & Witcoff, Ltd.

(57) ABSTRACT

A telescopic gangway, comprising a main gangway part and a telescoping gangway part that is telescopable with respect to the main gangway in a longitudinal direction. The gangway comprises a hoisting mechanism provided with a telescoping decoupling mechanism for compensating a variation of the wire end portion length caused by a telescoping movement of the telescoping gangway.

9 Claims, 4 Drawing Sheets

TELESCOPIC GANGWAY, A MOTION COMPENSATED GANGWAY AND A VESSEL

CROSS-REFERENCE TO RELATED APPLICATIONS

This application is a U.S. National Stage application under 35 U.S.C. § 371 of International Application PCT/NL2021/050486 (published as WO 2022/031165 A1), filed Aug. 2, 2021 which claims the benefit of priority to Application NL 2026198, filed Aug. 3, 2020. Benefit of the filing date of these prior applications is hereby claimed. Each of these prior applications is hereby incorporated by reference in its entirety.

BACKGROUND OF THE INVENTION

The invention relates to a telescopic gangway, comprising a main gangway part and a telescoping gangway part that is telescopable with respect to the main gangway in a longitudinal direction to adjust a longitudinal length of the telescopic gangway, the gangway being arranged for transporting persons and/or loads.

Telescopic gangways are generally know, e.g. in a motion compensated gangway comprising a movable transition deck and a telescopic gangway connected to the transition deck. The telescopic gangway typically has a tip that may be held, during operation of the motion compensated gangway, in close proximity of an object such as an offshore construction to or from which a load or a person has to be transferred. The movable transition deck has a base to be mounted on a vessel, and actuators, e.g. hydraulic pistons, to compensate for relative motion between the base or vessel and an object to or from which the load/person can be transferred. Said relative motion may for example result from waves or rolling, pitching, and/or yawing motion of a vessel or boat floating on the water.

A telescopic gangway comprises a first and second gangway part, for example a telescoping and main boom, which are telescopable with respect to each other in a longitudinal direction to adjust a longitudinal length of the telescopic gangway. Within the context of this application the term telescopable is meant to be construed as being movable, such as being able to move in and out of each other and/or with respect to each other along said longitudinal direction.

Motion compensated gangways per se, such as for compensating for vessel motions when transferring personnel and/or loads are known in the art. For example from the Ampelmann® system as disclosed in general in NL1027103, or systems disclosed in WO2012/138227 and WO2013/10564.

Patent publication NL1027103 discloses a vessel with a Stewart type construction for compensating motions of a ship. The construction comprises a transition deck, borne on six hydraulic cylinders, and motion sensors. During use, with the aid of the sensors, the motions of the vessel are measured. With the aid of these measurements, the orientation and/or position of the cylinders is driven continuously so that the transition deck remains approximately stationary relative to the fixed world. A luffing gangway is connected to the transition deck. In this manner, motions of the vessel are compensated and for instance people or loads can be transferred from the vessel onto a stationary offshore construction, or vice versa.

Telescopic gangways provided with a hoisting mechanism are also known. Then, a hoisting winch may be mounted to the main gangway part or to another structure that is mainly stationary along the longitudinal direction with respect to the main gangway part. Further, a hoisting sheave may be mounted to the telescoping gangway part. A hoisting wire runs from the hoisting winch to the hoisting sheave, the hoisting wire having a wire end portion suspending form the hoisting sheave downwardly.

However, in order to keep the hoisting load at constant height while being in motion compensation, the winch must actively counteract telescopic motion of the gangway, resulting in a complex, heavy and expensive actuator design. Further, the active telescoping mechanism is additionally loaded by ultimately twice the hoisting force, further increasing the complexity of the actuator design. When the gangway is used for people transfer, the unused hoisting system must be either on constant tension or active control to follow the telescopic motion, again rendering the winch design more complex and expensive. Further, when the hoisting wire jams at the winch, the height of the hoisting load cannot be controlled anymore. The load will then move by the telescopic motion of the motion compensation state, resulting in an unsafe and uncontrolled hoisting situation.

SUMMARY OF THE INVENTION

An object of the invention is to provide a telescopic gangway provided with a hoisting mechanism that mitigates the above mentioned disadvantages.

It is also an object of the invention to provide a telescopic gangway provided with a hoisting mechanism wherein the hoisting load is kept at a constant height while being in motion compensation without active winch operated counteraction.

Thereto, according to an aspect of the invention, a telescopic gangway is provided, comprising a main gangway part and a telescoping gangway part that is telescopable with respect to the main gangway in a longitudinal direction to adjust a longitudinal length of the telescopic gangway, the gangway being arranged for transporting persons and/or loads, wherein the gangway is provided with a hoisting mechanism, comprising a hoisting winch mounted to the main gangway part or to another structure that is mainly stationary along the longitudinal direction with respect to the main gangway part, a hoisting sheave mounted to the telescoping gangway part, and a hoisting wire running from the hoisting winch to the hoisting sheave, the hoisting wire having a wire end portion suspending from the hoisting sheave downwardly, the hoisting mechanism further comprising a telescoping decoupling mechanism for compensating a variation of the wire end portion length caused by a telescoping movement of the telescoping gangway, wherein the telescoping decoupling mechanism comprises a main sheave mounted to the main gangway part, a sheave assembly that is located between the hoisting winch and the main sheave and that is freely movable along the longitudinal direction, the sheave assembly having a proximal sheave and a distal sheave, wherein the hoisting wire is routed from the winch to the main sheave, from the main sheave towards the distal sheave, and from the distal sheave to the hoisting sheave, and wherein the telescoping decoupling mechanism further comprises an additional wire running from a first fixation point on the main gangway part or on another part that is mainly stationary along the longitudinal direction with respect to the main gangway part towards the proximal sheave, and from the proximal sheave to a second fixation point on the telescoping gangway part, the first fixation point and the second fixation point being proximal relative to the sheave assembly.

By applying a telescoping decoupling mechanism provided with a main sheave, a movable sheave assembly tensioned via an additional wire as specified above, a dedicated passive pulley mechanism is obtained compensating for telescopic motion compensating by movement of the movable sheave assembly at half the speed of the motion of the telescopic gangway part. Effectively, the telescoping motion is decoupled from the hoisting motion. Then, the hoisting load is kept at a constant height while being in motion compensation without active winch operated counteraction. Further, the winch design can be relatively simple and small, reducing manufacturing and maintenance costs.

Preferably, the hoisting sheave is mounted to a distal end of the telescopic gangway part. However, the hoisting sheave may also be mounted offset from the distal end of the telescoping gangway part.

Similarly, the main sheave may be mounted to a distal end of the main gangway part, or offset therefrom.

Advantageously, the sheave assembly is located between the main sheave and the second fixation point on the telescoping gangway part, so as to define a proper working range of the sheave assembly.

Optionally, the main gangway part comprises a guiding structure for guiding the sheave assembly along the longitudinal direction for stabilizing movement of the sheave assembly.

The invention also relates to a motion compensated gangway and a vessel.

The invention will be further elucidated on the basis of exemplary embodiments which are represented in the drawings. The exemplary embodiments are given by way of non-limitative illustration of the invention. In the drawings:

DETAILED DESCRIPTION

Figure 1A:
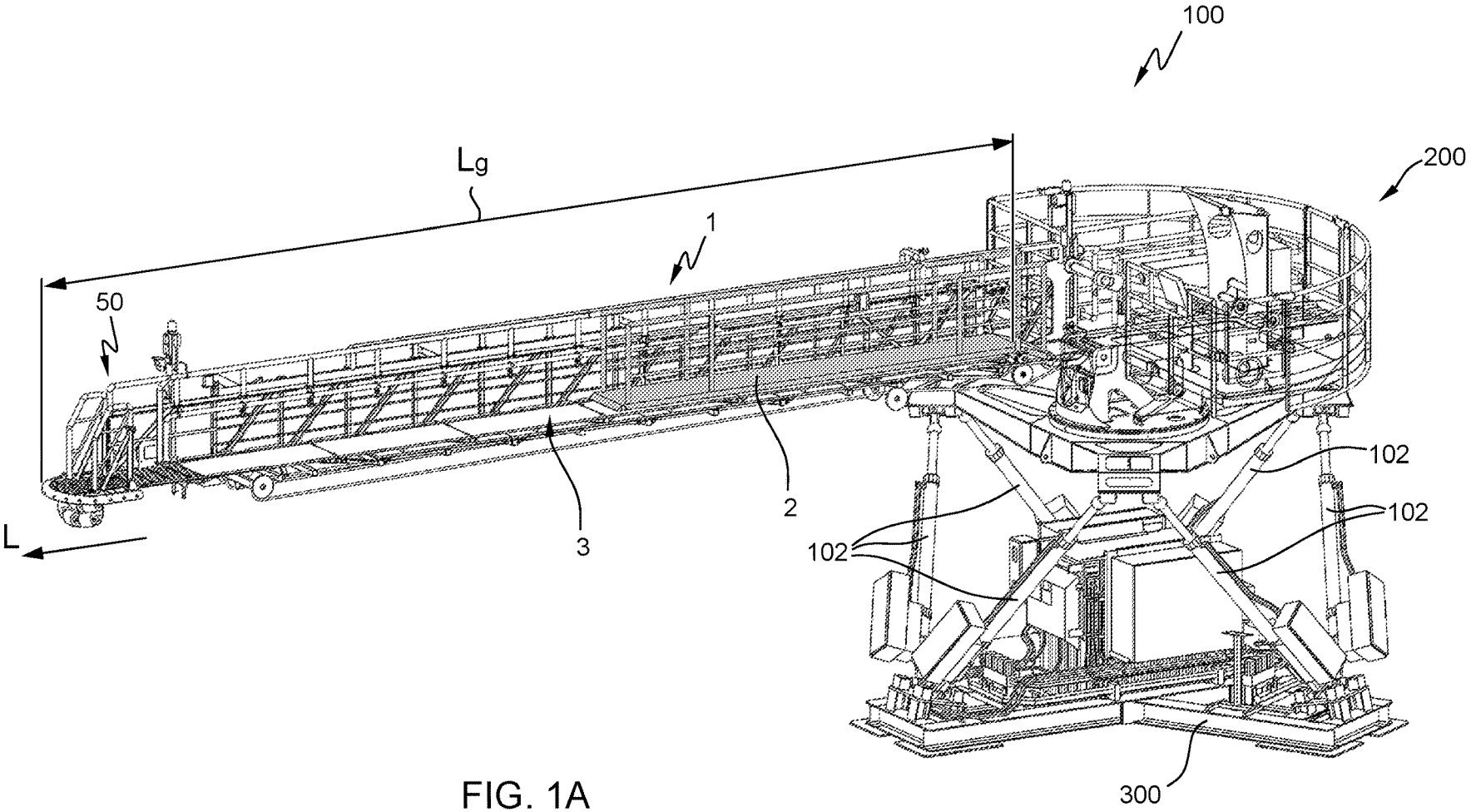
FIG. 1A shows a schematic perspective view of a motion compensated gangway according to the invention.

In the figures identical or corresponding parts are represented with the same reference numerals. The drawings are only schematic representations of embodiments of the invention, which are given by manner of non-limited examples.

FIG. 1A shows a schematic perspective view of a motion compensated gangway 100 according to the invention. Generally, a motion compensated gangway 100 comprises a movable transition deck 200 and a telescopic gangway 1 connected to the transition deck 200. The telescopic gangway 1 has a tip 50 that may be held, during operation of the motion compensated gangway 100, in close proximity of an object 500 such as an offshore construction to or from which persons and/or loads have to be transferred. The movable transition deck 200 has a base 300 to be mounted on a vessel 400, and actuators 102 interconnected between the movable transition deck and the base, e.g. hydraulic pistons or electric actuators, to compensate for relative motion between the vessel 400 on which the base 300 is mounted and the object 500 to or from which the persons and/or loads can be transferred. Said relative motion may for example result from waves or rolling, pitching, and/or yawing motion of the vessel 400 or boat floating on the water 600.

It is noted that the actuators 102 can be located between the movable transition deck 200 and the base 300 carrying the deck 200, e.g. implemented as a hexapod as shown in FIG. 1A. However, the actuators 102 can be located elsewhere on the motion compensated gangway, e.g. as gangway actuators moving the telescopic gangway 1 itself, i.e. applying only gangway motion compensation, i.e. performing motion compensation by telescopic movement of the telescopic gangway, e.g. in case no hexapod type construction or other movable transition deck 200 and base 300 construction is used for carrying the telescopic gangway. As an example, a so-called L-type telescopic gangway 1 may be applied wherein the telescopic gangway 1 is mounted to the vessel via a mounting construction that does not compensate for motion between the vessel and the object to or from which the persons and/or loads can be transferred.

Figure 1B:
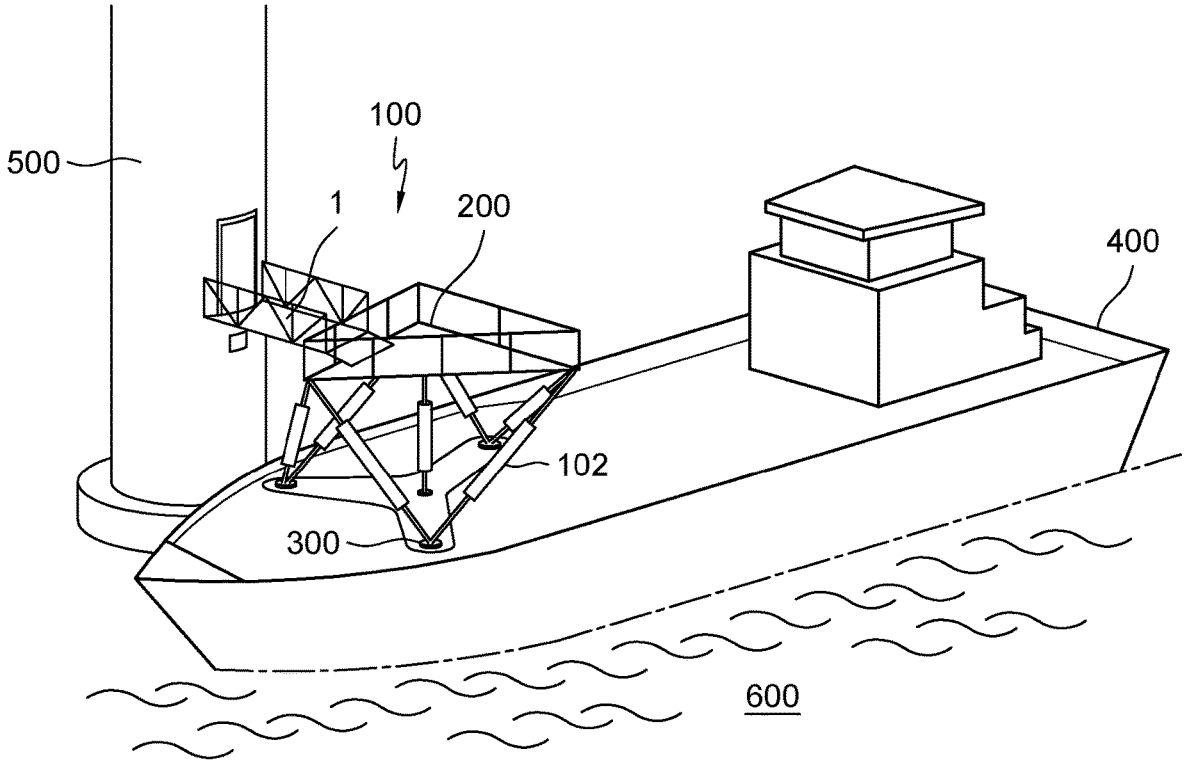
FIG. 1B shows a schematic perspective view of a vessel provided with the motion compensated gangway shown in FIG. 1.

FIG. 1B shows a schematic perspective view of a vessel 400 provided with the motion compensated gangway 100 shown in FIG. 1;

The telescopic gangway 1 generally comprises a main boom 2 and a telescoping boom 3 that is telescopable with respect to the main boom 2 in a longitudinal direction L to adjust a longitudinal length $L_g$ of the telescopic gangway 1. Within the context of this application the term telescopable is meant to be construed as being movable, such as being able to move in and out of each other and/or with respect to each other along said longitudinal direction L.

The main and telescoping boom 2, 3 may each have a walkboard or walkplank to facilitate transfer of persons and/or goods.

Figure 2:
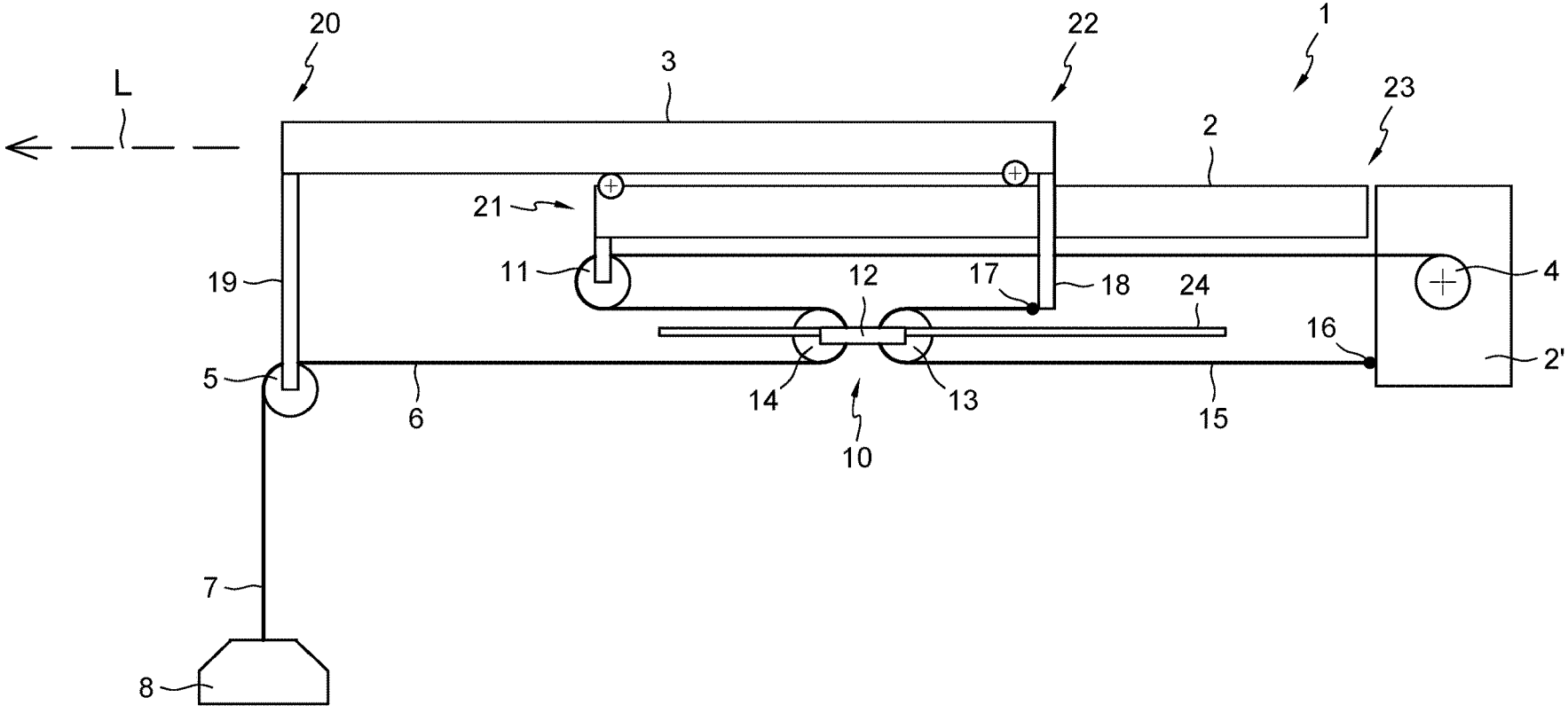
FIG. 2 shows a schematic side view of a telescopic gangway according to the invention, in a first state.

FIG. 2 shows a schematic side view of a telescopic gangway 1 according to the invention, in a first state wherein the telescoping boom 3 is located at a first position relative to the main boom 2 along the longitudinal direction L.

The gangway 1 has a hoisting mechanism, comprising a hoisting winch 4 mounted to a structure, such as the movable transition deck 200, that is mainly stationary along the longitudinal direction L with respect to the main gangway part 2. Alternatively, the hoisting winch 4 may be mounted to the main gangway part 2 itself. Further, the hoisting mechanism includes a hoisting sheave 5 mounted to the telescoping gangway part 3, in the shown embodiment at its distal end 20, and a hoisting wire 6 running from the hoisting winch 4 to the hoisting sheave 5, the hoisting wire 6 having a wire end portion 7 suspending from the hoisting sheave 5 downwardly. In the shown embodiment, the wire end portion 7 is loaded with a load 8 to be transferred.

It is noted that, in principle, the hoisting sheave 5 may be mounted at another location to the telescoping gangway part 3, e.g. offset from the distal end 20 of the telescoping gangway part 3. Further, in the shown embodiment, the hoisting sheave 5 is mounted to the telescoping gangway part 3 via a mounting frame 19.

The hoisting mechanism further comprises a telescoping decoupling mechanism 10 for compensating a length variation of the wire end portion 7 that may be caused by a telescoping movement of the telescoping gangway 1, i.e. when the telescoping gangway part 3 moves from a first distance relative to the main gangway part 2 to a second distance relative to the main gangway part 2, along the longitudinal direction L.

The telescoping decoupling mechanism comprises a main sheave 11 mounted to the main gangway part 2, in the shown embodiment at its distal end 21, and a sheave assembly 12 that is located between the hoisting winch 4 and the main sheave 11. The sheave assembly is freely movable along the longitudinal direction L, and is provided with a proximal sheave 13 and a distal sheave 14. The hoisting wire 6 is routed from the winch 4 to the main sheave 11, from the main sheave 11 towards the distal sheave 14, and from the distal sheave 14 to the hoisting sheave 5.

It is noted that, in principle, the main sheave 11 may be mounted at another location to the main gangway part 3, e.g. offset from the distal end 21 of the main gangway part 3.

The telescoping decoupling mechanism further comprises an additional wire 15 running from a first fixation point 16 on a part, such as such as the movable transition deck 200, that is mainly stationary along the longitudinal direction L with respect to the main gangway part 2, towards the proximal sheave 13, and from the proximal sheave 13 to a second fixation point 17 on the telescoping gangway part 3. As an alternative, the first fixation point 16 is on the main gangway part 2 itself. Further, in the shown embodiment, the second fixation point 17 is on the telescoping gangway part 3 via an intermediate frame 18. Here, the first fixation point 16 and the second fixation point 17 are proximal relative to the sheave assembly 12, i.e. the first fixation point 16 and the second fixation point 17 are closer to the winch 4 than the sheave assembly 12.

In the shown embodiment, the sheave assembly is located between the main sheave 11 and the second fixation point 17 on the telescoping gangway part 3 so as to facilitate proper functioning of the telescoping decoupling mechanism.

Further, in the shown embodiment, the main gangway part comprises a guiding structure 24 for guiding the sheave assembly 12 along the longitudinal direction L, in order to counteract transverse movements of the sheave assembly 12. In principle, however, the telescopic gangway 1 may be provided with such guiding structure.

Generally, the sheaves, including the hoisting sheave 5, the main sheave 11, the proximal sheave 13 and the distal sheave 14, as well as the winch 4 are rotatable about a corresponding mainly horizontal axis transverse to the longitudinal direction L.

Figure 3:
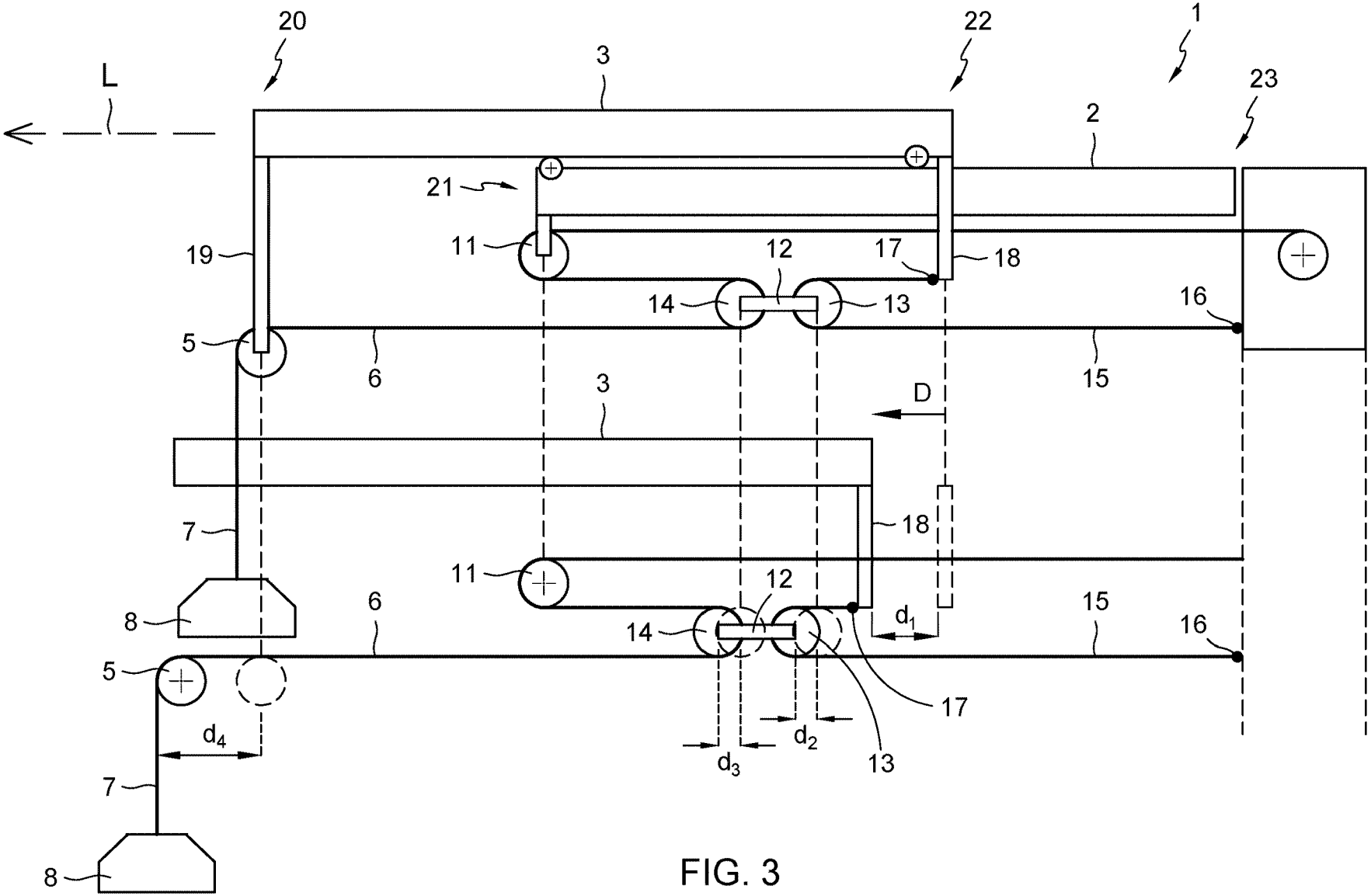
FIG. 3 shows a schematic side view of the telescopic gangway shown in FIG. 2, in a first and second state.

FIG. 3 shows a schematic side view of the telescopic gangway 1 shown in FIG. 2, in a first and second state. The upper portion of FIG. 3 shows the telescopic gangway 1 in the first state, similar to FIG. 2. The lower portion of FIG. 3 shows the telescopic gangway 1 in the second state, wherein the telescoping boom 3 has shifted from the first position relative to the main boom 2 along the longitudinal direction L, to a second position relative to the main boom 2 along the longitudinal direction L.

In said second state, the telescoping boom 3 has shifted into the longitudinal direction L, in FIG. 3 to the left, over a shifting distance D, extending the telescopic gangway 1. Then, the second fixation point 17 has shifted over a first distance $d_1$ to the left, the first distance $d_1$ being equal to the shifting distance D. The proximal sheave 13 has also shifted to the left, over a second distance $d_2$ being equal to half of the shifting distance D, as the length of the additional wire 15 remains constant. Then, the sheave assembly 12 including the distal sheave 14 shifts over a third distance $d_3$ to the left, equal to the second distance $d_2$, the third distance $d_3$ being equal to half of the shifting distance D. The hoisting sheave 5 has also shifted to the left, over a fourth distance $d_4$ being equal to the shifting distance D. As the main sheave 11 has not shifted, the shift of the distal sheave 14 over the third distance $d_3$ compensates for the shift of the hoisting sheave 5 over the fourth distance $d_4$. Then, the length of the wire end portion 7 does not vary during a telescoping movement of the telescoping gangway 1.

Various variations are possible.

It will be clear to the skilled person that the invention is not limited to the exemplary embodiment represented here. Many variations are possible.

Such variations shall be clear to the skilled person and are considered to fall within the scope of the invention as defined in the appended claims.

LIST OF REFERENCE SIGNS

L Longitudinal direction
$L_g$ Length of telescopic gangway
1. Telescopic gangway
2. Main gangway part
3. Telescoping gangway part
4. Hoisting winch
5. Hoisting sheave
6. Hoisting wire
7. Wire end portion
8. Load
10. Telescoping decoupling mechanism
11. Main sheave
12. Sheave assembly
13. Proximal sheave
14. Distal sheave
15. Additional wire
16. First fixation point
17. Second fixation point
18. Intermediate frame
19. Mounting frame
20. Distal end of telescopic gangway part
21. Distal end of main gangway part
22. Proximal end of telescopic gangway part
23. Proximal end of main gangway part
24. Guiding structure
100. Motion compensated gangway
102. Actuators
200. Movable transition deck
300. Base

The invention claimed is:

1. A telescopic gangway, comprising a main gangway part and a telescoping gangway part that is telescopable with respect to the main gangway in a longitudinal direction to adjust a longitudinal length of the telescopic gangway, the gangway being arranged for transporting persons and/or loads, wherein the gangway is provided with a hoisting mechanism, comprising a hoisting winch mounted to the main gangway part or to another structure that is mainly stationary along the longitudinal direction with respect to the main gangway part, a hoisting sheave mounted to the telescoping gangway part, and a hoisting wire running from the hoisting winch to the hoisting sheave, the hoisting wire having a wire end portion suspending from the hoisting sheave downwardly, the hoisting mechanism further comprising a telescoping decoupling mechanism for compensating a variation of the wire end portion length caused by a telescoping movement of the telescoping gangway, wherein the telescoping decoupling mechanism comprises a main sheave mounted to the main gangway part, a sheave assembly that is located between the hoisting winch and the main sheave and that is freely movable along the longitudinal direction, the sheave assembly having a proximal sheave and a distal sheave, wherein the hoisting wire is routed from the winch to the main sheave, from the main sheave towards the distal sheave, and from the distal sheave to the hoisting sheave, and wherein the telescoping decoupling mechanism further comprises an additional wire running from a first fixation point on the main gangway part or on another part that is mainly stationary along the longitudinal direction with respect to the main gangway part towards the proximal sheave, and from the proximal sheave to a second fixation point on the telescoping gangway part, the first fixation point and the second fixation point being proximal relative to the sheave assembly.

2. The telescopic gangway according to claim 1, wherein the hoisting sheave is mounted to a distal end of the telescoping gangway part.

3. The telescopic gangway according to claim 1, wherein the main sheave is mounted to a distal end of the main gangway part.

4. The telescopic gangway according to claim 2, wherein the sheave assembly is located between the main sheave and the second fixation point on the telescoping gangway part.

5. The telescopic gangway according to claim 1, wherein the main gangway part comprises a guiding structure for guiding the sheave assembly along the longitudinal direction.

6. A motion compensated gangway, comprising a movable transition deck and the telescopic gangway according to claim 1, the telescopic gangway being connected to the transition deck.

7. The motion compensated gangway according to claim 6, wherein the movable transition deck has a base to be mounted on a vessel, and actuators interconnected between the movable transition deck and the base to compensate for relative motion between the base and an object to or from which the persons and/or loads can be transferred.

8. A motion compensated gangway, comprising the telescopic gangway according to any claim 1, wherein the telescopic gangway is provided with actuators for driving a telescopic movement of the telescoping gangway part relative to the main gangway part to compensate for relative motion between the base and an object to or from which the persons and/or loads can be transferred.

9. A vessel on which the motion compensated gangway according to claim 6 has been mounted.

* * * * *